United States Patent [19]

Nava

[11] Patent Number: 4,615,052

[45] Date of Patent: Oct. 7, 1986

[54] HELMET WITH TILTING VISOR ESPECIALLY SUITED FOR SPORTS USE

[76] Inventor: Pier L. Nava, via Carnovali 100/c, Bergamo, Italy

[21] Appl. No.: 572,768

[22] Filed: Jan. 23, 1984

[30] Foreign Application Priority Data

Feb. 14, 1983 [IT] Italy ..... 19570/83

[51] Int. Cl.[4] ..... A42B 1/08

[52] U.S. Cl. ..... 2/424; 2/9; 2/10; 2/427

[58] Field of Search ..... 2/424, 425, 410, 450, 2/451, 453, 427, 431, 435, 436, 437, 438, 12, 15, 6, 9, 10

[56] References Cited

U.S. PATENT DOCUMENTS 4,223,410 9/1980 Nava ..... 2/424
4,242,757 1/1981 Nava ..... 2/10
4,312,078 1/1982 Pollitt et al. ..... 2/424

FOREIGN PATENT DOCUMENTS 2004178 3/1979 United Kingdom ..... 2/424

*Primary Examiner*—Werner H. Schroeder
*Assistant Examiner*—J. L. Olds
*Attorney, Agent, or Firm*—Ladas & Parry

[57] ABSTRACT

Visor (B) is secured to helmet (A) by hinge devices (C) each consisting of an arched guideway (12) for a slider (10). The pattern of guideway (12) in its rear terminal tract is such as to draw slider (10) toward the rear top part of the helmet to ensure engagement of visor edge (B) to the bottom of edge (A1) of the helmet's opening.

Likewise, the front terminal tract of arched guideway (12) is conceived in a manner such as will ensure elastic engagement of top edge (34) of the visor with the curved top surface ($A_2$) of the helmet when the visor is lifted. Notches and elastic teeth (26–27) are provided between arched guideway (12) and slider (10); the notches and teeth make it possible to form between visor edges (B) and the opening of helmet (A), a ventilation slot for de-fogging the visor. Ventilation of the helmet is further improved by slots (52) in the front-rear part ($A_3$) of the helmet connecting the exterior with a chamber (50) which outlets at visor (B) through a slot.

5 Claims, 8 Drawing Figures

HELMET WITH TILTING VISOR ESPECIALLY SUITED FOR SPORTS USE

DESCRIPTION

This invention relates to a helmet with tilting visor, particularly suited for use in sports.

Sport helmets affording a fairly satisfactory degree of protection the wearer are known in the art; however, not all of these are adequate to satisfy all end use requirements, especially internal ventilation in adverse atmospheric condition; moreover, handling of the visor, especially when closed, is not easy.

This invention proposes to provide a helmet apt to afford a rational and satisfactory actuation of the visor, in the sense that it can be shifted by the user with a single simple reliable operation, using one hand only, and brought in the lowered position or in any position comprised between said lowered position and maximum lifted position, in particular the object of the invention is to provide a helmet in which the visor can be lifted so as to delimit a slot in conjunction with the bottom edge of the helmet's opening, said slot being adjustable by the operator at will, to determine the desired internal ventilation of the helmet, whilst inhibiting any penetration of moisture and water through the top part of the visor when this is partly or fully lifted from the helmet.

A further object of the invention is to provide a helmet the interior of which is ventilated even when the visor is fully lowered, for the purpose of avoiding fogging of said visor.

The helmet according to the invention, with the visor hinged to its side walls and sunken edge is characterized in that each one of the visor's hinging means is provided with an arched guide way for a slider, the center of the axis of curvature of which coincides substantially with the real hinging axis of said visor; the slider retains the end of the visor and slides in said curved guideway between stops apt to establish the limit travel positions for the visor.

According to the invention the pattern of the curved guide way consists of a mid tract whose curvature radius center coincides substantially with the real actual center of the axis of the visor's hinge, while the rear end of the guideway is orientex toward the top rear part of the helmet to draw thus the visor's edge to the lowered position against and in engagement with helmet's front opening.

Moreover, the front of the helmet is provided with a series of slots communicating through a damper, operated by the user, with an internal chamber formed, at least in part, by the helmet's inside wall, to direct toward the visor, through a longitudinal slot, an air blade, apt to eliminate possible fogging and also to improve ventilation.

To ensure renewal of the air inside the helmet even when the visor is lowered, the visor is provided toward its ends with flaps opening laterally and directed toward the rear part of the helment, to eject the internal air which is thus renewed.

The patent will now be explained in conjunction with the annexed drawings which illustrate, by way of example, one preferred form of embodiment of a complete helmet incorporating the characteristics of the invention, as well as some variants thereof.

Specifically:

Figure 3:
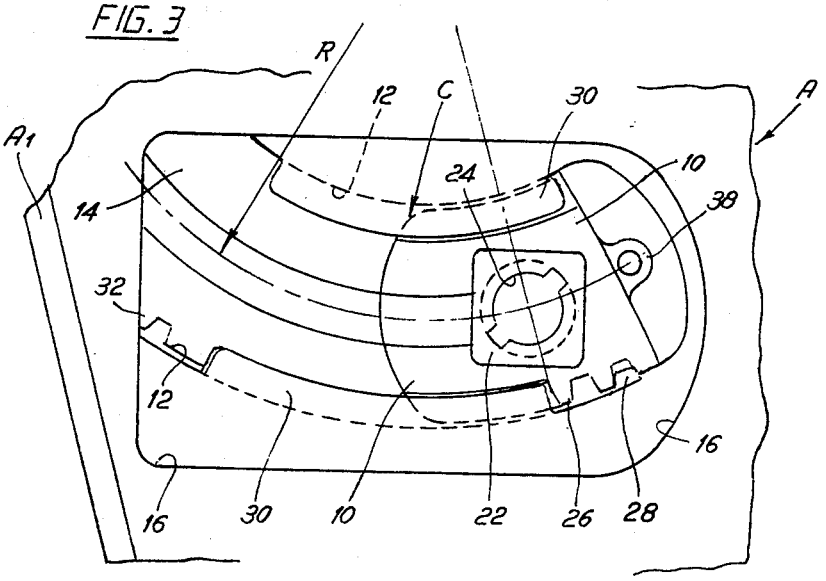
FIG. 3 is a detail view of a part of the means to hinge the visor to the helmet.
Figure 5:
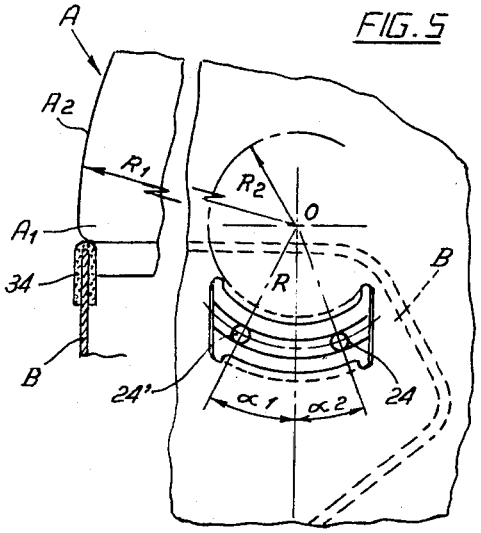
Figure 6:
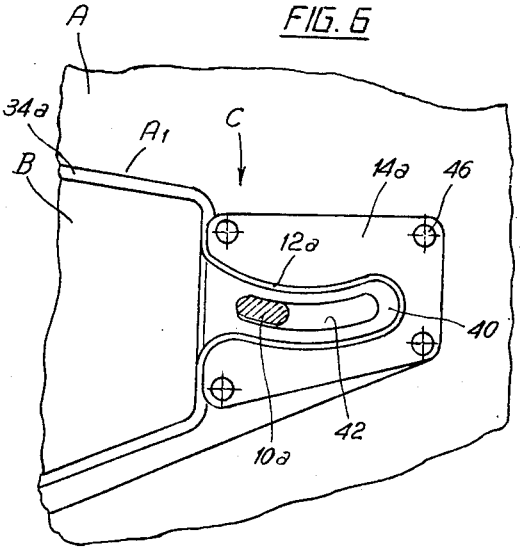
Figure 7:
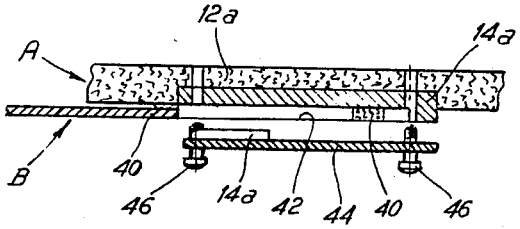

FIG. 5 which is similar to FIG. 3, shows the geometrical characteristics of the means that for hinging the visor to the helmet;

FIG. 6 is a fragmentary view, with parts removed, of a variant of another embodiment of the means that for hinging the visor to the helment;

FIG. 7 is an exploded longitudinal cross sectional view of FIG. 6; and

Figure 8:
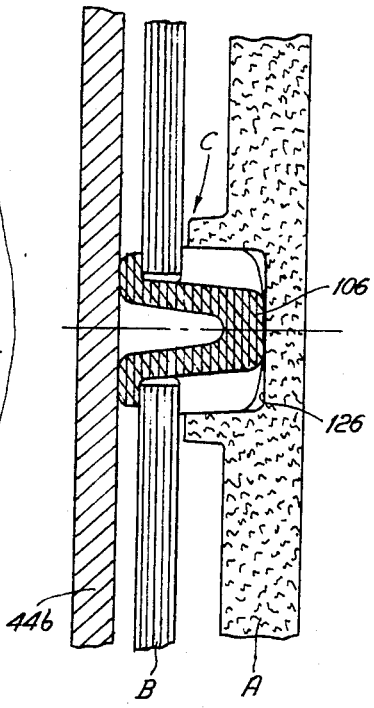

FIG. 8 is the vertical cross section of a variant of the hinge means according to FIG. 6 and 7.

In the different figures and drawings, the helmet body or housing is designated by letter (A); it is provided, in the known manner, with a front opening, the edge (A1) of which is lowered to house the edge of visor (B), secured to helmet (A) by hinges (C), which are the object of this invention.

Figure 1:
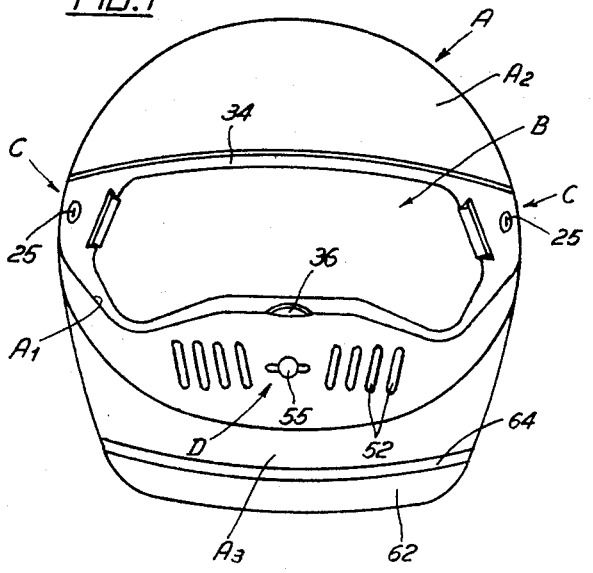
FIG. 1 is a front elevational view of the helmet according to the invention.
Figure 2:
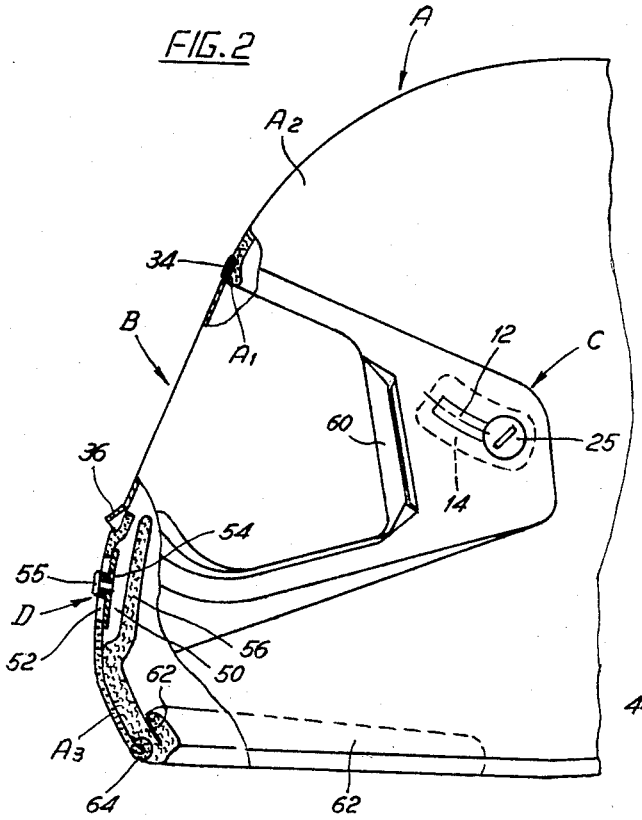
FIG. 2 is a side view, of a larger scale, showing cross section of the parts of the helmet of FIG. 1.

In the case illustrated in FIGS. 1 and 2, body (A) of the helmet is provided on its front bottom part with aerating means (D) apt to aerate the interior of the helmet, to avoid fogging of said visor (B). With reference to FIGS. 1 and 5, we will now describe one of the two means (C) used to hinge visor (B) to helmet (A).

The hinging means consists of a slider (10) running slidably in arched guideways (12) in the side walls of helmet (A) and having suitable characteristics as will be described infra.

Moreover, said arched guideways may in actual practice be obtained by direct molding in the side walls of helmet (A) or by applying them to said walls by means of relevant molded blocks (14) (see FIGS. 3 and 4) each housed in a recess (16) in said side wall and provided with pins (18) with elastic head pins engageable by snap action in holes (20) on the bottom of said recess.

Figure 4:
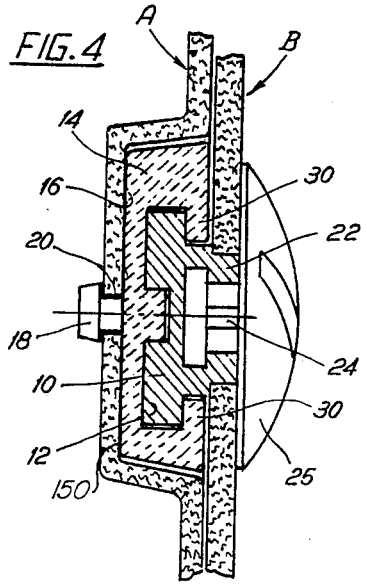
FIG. 4 is a view according to line I—I of FIG. 1.

As is shown by FIG. 4 the outside surface 150 of the arched guidways (guiding means) is attached to the shell of the helmet.

Slider (10) is provided, in its center part with a polygonal projecting part (22) with hole (24), either threaded or restrained, to hold visor (b) by means of a threaded button (25), said visor (B) being thus retained by said slider (10).

However, if required by end use, securing of the visor to slider (10) may be effected by the interposition between the engagement surfaces of these parts, of elastically yielding gaskets to allow an angular fractioned movement to said parts.

Slider (10) is provided, toward its rear end, with a radial tooth (26) (FIG. 3) which engages one of the plurality of teeth (28) in one of wings (30) of arched guideway (12).

Radial tooth (26) is suitably sprung; for example, it can be made of elastic material to maintain thus suitably spaced the bottom edge of visor (B) from edge (A) which delimits the helmet's front opening.

The slot formed by the two edges just considered, forms while the vehicle is running, an air blade which strikes the internal surface of visor (B) thereby avoiding fogging of the latter and also creating a rational ventilation of the helmet's interior.

It is obvious that the positioning of visor (B) in its final positions is achieved by means of suitable stops located between slider (10) and arched guideways (12) in case visor (B) is set in the uplifted position, slider (10) is provided on its front end with a tooth similar to tooth (28) which may be formed by the front edge of said slider (10) and which engages a stop (32) in arched guideway (12).

On the other hand, visor B is retained in its lowered position, in addition to possible stops between slider (10) and arched guideway (12), also and mainly by the geometrical characteristics of said arched guideways (12) to obtain adherence of the edge of visor (B) to the bottom of the ledge on the sunken edge (A1) of the helmet's opening.

According to this invention the edge of visor (B), in particular its top edge, is provided with an elastic gasket (34); when the visor is lifted, said gasket is abut with outer top surface ($A_2$) of helmet (A) thereby to avoid water penetration inside the helmet and on the inner surface of visor (B). As shown in FIGS. 1 and 2 the lower edge of visor (B) is provided, in its mid part, with a shaped projecting part, (36), the back of which forms an engagement surface for the wearer's finger to grasp and lift the visor and shift and block it in the desired angular position.

As already stated, when visor (B) is lifted, its top edge, specifically elastic gasket (34), slides and adheres to the top surface ($A_2$) of the helmet; this ensures retainment and positioning of the visor in the desired position, inhibiting at the same time any penetration of water into the helmet's interior.

The positioning and retainment of visor (B) in its lowered position (in which the visor's peripheral edge is caused to adhere elastically to the bottom of ledge (A) on the edge of the helmet's opening), are achieved by imparting to guideway (12) either a suitable curvature or by placing said guideway in a suitable position with respect to the curvature in front top zone ($A_2$) of helmet (A), that is, zone ($A_2$) involved in the travel of visor (B).

These and other conditions will be described hereafter with reference to FIG. 5.

In this figure the parts of the hinge device (C) considered in FIGS. 1 thru 4, are identified by the same reference numbers. Specifically, (12) is arched guideway for slider (10) and the centers of holes (24) are identified by numbers (24—24') when the slider is in its terminal positions, (visor (B) lowered or lifted). Again with reference to FIG. 5, letter (R) identifies the radius of curvature of curved guideway (12), the center (O) of which coincides with the center of the ideal hinging axis of visor (B). Said center (O) is also the center of radius of curvature (R) of the curved zone of helmet A already considered in FIG. 5, radius (R1) is shown reduced with respect to reality (actual), to facilitate visualization. Moreover, again in the case of FIG. 5, the center (O1) of said radius (R1) lies on a radius circumference (R2) on which lie different centers (O) of different radii which determine the actual profile of the zone considered of helmet (A) while in this case, radius (R2) corresponds to the average radius of the different radii of curvature of helmet (A).

In practice, radius (R) relating to the curvature of guideway (12) varies from ½ to 1/10 of the average radius (R1) of the radii of curvature of zone ($A_2$) of the top front wall of helmet (A). Center (O) of radius (R) can coincide with center (O1) of average radius (R1) when said radius is horizontal; otherwise, center (0) of radius (R) is spaced by a radius (R2) of the circumference on which lie at least three of the elementary centers of the radius of curvature pertinent to the curvature of surface ($A_2$) delimited at the median vertical plane of helmet (A). Therefore, the value of radius (R2) can be comprised between zero and ½ of the mean radius (R1) mentioned.

In practice, radius (R) of arched guideway (12) is comprised between 15 and 60 mm, preferably between 20 and 40 mm; the center (O) is spaced from surface ($A_2$) by a distance comprised between 90 and 130 mm.

Lastly, the angular amplitude $\alpha 1+\alpha 2$ of arched guideway 12, measured from the vertical passing through center (O), is $\alpha 1=50°\div 15+\alpha 2=30°\div 5°=80°\div 20°$; in practice, however $\alpha 1=25°\div 35°$; $\alpha 2=15°\div 25°=\alpha 1+\alpha 2=60°\div 40°$ In particular, angle $\alpha 2$ must be such as to impart to the terminal part of arched guideway (12) an orientation such as to retract upwardly thereby to exert on the edge of visor (B), in particular its lower edge, a pulling action to cause said edge ($A_1$) of the opening of helmet (A) to adhere constantly.

Obviously, this result can be obtained also by suitably shaping the terminal tract of curved guideway (12) to ensure adherence of the edge of visor (B) to the bottom of the ledge in edge ($A_1$).

The adherence of elastic gasket (34) to surface ($A_2$) of the helmet during shifting of the visor is ensured also by the inherent elasticity of the lamina of which visor (B) is made.

FIGS. 6 and 7 illustrate an advantageous variant of embodiment of hinge (C) of visor (B) which maintains valid the inventive concept above described. In this variant, visor (B) is provided at each one of its ends with curved wings (40) having the geometrical characteristics already considered in connection with the hinge assembly (C) in FIGS. 2 and 4.

The single curved wings (40) move slidably in curved guideways (**12*a*) in a plate (14*a***) retained by helmet (A) in the manner that will now be described.

Curved wing (40) is provided in its mid part with a curved slot (42) in which engages a curved projecting part (**10*a*) retained by a counter-plate (44) forming a cover, together with the parts considered, secured to helmet (A) by screws or rivets (46) which thus retain in slidable relation curved wing (42**) to visor (B).

Also in this variant, visor (B) is retained in the positions required from time to time, both by projection (**10*a***) and by the geometrical arrangement of the different parts forming the hinge assembly (C) just illustrated.

The variant shown in FIG. 8 corresponds substantially to that relating to the hinge assembly (C) just considered. Vizor (B) retains a block (**10*b*) made of suitable elastic material which slides by friction in a curved groove (12*b*) in the side wall of helmet (A) and the pattern of which corresponds to that of FIG. 5**.

Said visor, together with elastic block (**10*b*) are secured to the wall of helmet (A) by a cover 44*b*), secured to said wall by screws or similar means. In this variant, the angular positioning of visor (B) is achieved by the attrition of elastic block (10*b*) against the walls of groove (12*b***).

Obviously, and if required the latter may be provided with pairs of prongs and notches whose elements are located at angular positions in the walls of arched groove (**12*b*) and in sprung block (10*b***).

Obviously, the characteristic parts of the invention, that is, block (10) and arched groove (12) may in like manner be provided both between cover (**44*b*) and visor (B) and between the latter and said cover (44*b***), that is, between a fixed part of helmet (A) and a movable part pertaining to visor (B).

As already stated, helmet (A) illustrated is provided with aerating means (D) combined with the means formed by the edges of visor (B) and the front opening (A) of the helmet to complete the internal ventilation of helmet (A).

The provision of a double ventilating system is required in relation to the particular structure of the helmet when the lower opening of the latter is substantially fully closed, for example by collars or similar devices formed by one or more segments hinged to the base of the helmet and which surround the wearer's neck.

A chamber (50) is delimited inside the helmet by padding (56), suitably shaped to conform to the bottom part of the helmet's opening. A slot extends throughout the width of the helmet's opening.

It is evident that the ventilating slot formed by controlled lifting of visor (B) improves ventilation also of the lower and rear parts of the helmet especially when the latter, as above stated, is closed on its bottom part by a collar or, for example by a baffle which may be concealed.

In FIG. 2 said baffle consists of a flop (62) extending downwardly from the bottom edge of the helmet's opening.

Flop (62) is retained on the edge of the helmet's lower opening by a flexible listel or strip (64) arranged so as to permit tilting of said flap by approx. 180°.

The flap (62) can have two positions which accommodate the needs of the user. In a first position, the flap (62) may be tilted and adhere to the surface of a padding (56) as shown in FIG. 2. In this position of the flap, the user can put the helmet on and remove it from his head.

In a second position, the flap (62) is positioned downwardly so that an outside edge thereof is located near and surrounds at least a substantial portion of the neck of the user to provide a substantial closure of the helmet's lower opening. When the flat (62) is positioned in its second position, it serves as a shield against the flow of air which strikes the user when a vehicle is moving.

The characteristics of shape and dimensions of flap (62) may be varied depending on end use requirements; for example, the flap may consist of two or more segments which may be tilted separately to extend also toward the rear part of the helmet's lower opening.

Said flap (62) may be retained movably by the edge of the helmet's padding (56), for example by means of buttons, hooks, sliding hinges etc., to permit its replacement without difficulty.

Modifications may be introduced in hinging element (C) according to the invention, depending on the specific characteristics of the helmets considered; thus, for example, the sliding surfaces between slider (10) and arched guideway (12) may be rough or knurled to restrain the shifting movement of the visor.

It is understood in any case, that the introduction of any such modifications will not constitute a departure from the domain and spirit of the invention.

I claim:

1. A helmet arrangement comprising an outside shell, said shell having an opening in a front portion thereof, said opening engaging with a visor, said visor being movably attached by at least one sliding means to said outside shell for movement from an open to a closed position of the visor and vice versa, said sliding means comprising guiding means having an outside surface thereof attached to an outside surface of said shell and having an inside surface slidably receiving a sliding member, said visor being attached to said sliding member by attaching means, said guiding means having a substantially hollow central region receiving said sliding member to prevent movements of said sliding member within the guiding means in a direction substantially perpendicular to an axis of sliding of the sliding member; said visor being attached to said sliding member by attaching means, said sliding member having at least one engaging tooth, said guiding means having a plurality of receiving means on an inside surface thereof for close engagement with said tooth of the sliding member, and wherein said visor can be fixed in a predetermined position by locating said tooth within said receiving means.

2. A helmet arrangement according to claim 1 wherein said visor, guiding means and sliding member have a curved configuration and a center of a radius of a curvature of said guiding means and sliding member substantially coincides with a center of a radius of a curvature of said visor.

3. A helmet arrangement according to claim 1 wherein said visor, guiding means and sliding member have a curved configuration and the length of an arc of a center line of said guiding means and sliding member extends between 40° and 100° of a circumference having said arc as a portion thereof and the center of a radius of curvature of said guiding means and sliding member substantially coincides with a center of a curvature of the outside shell of the helmet.

4. A helmet arrangement according to claim 3 wherein the angle of the arc defining the center line of said guiding means and sliding member is divided by a vertical line passing through the center of the radius of the arc on two angles so that the ends of said guiding means are diverged and directed upwardly to retain said sliding member in a position which will ensure movement of the visor within the opening.

5. A helmet arrangement according to claim 1 wherein the position of said attaching means on said sliding member and visor can be adjusted.

* * * * *